US005842919A

United States Patent [19]

Lyons et al.

[11] Patent Number: 5,842,919

[45] Date of Patent: Dec. 1, 1998

[54] DAMPER ACTUATOR ASSEMBLY

[75] Inventors: John Lyons, Levitown; Allan A. Angerer, East Meadow, both of N.Y.

[73] Assignee: Duro Dyne Corporation, Farmingdale, N.Y.

[21] Appl. No.: 824,950

[22] Filed: Mar. 27, 1997

[51] Int. Cl.[6] ..... F24F 13/15

[52] U.S. Cl. ..... 454/336; 137/601; 454/335

[58] Field of Search ..... 454/224, 325, 454/326, 335, 336; 137/601

[56] References Cited

U.S. PATENT DOCUMENTS

| | | | |
|---|---|---|---|
| 1,737,946 | 12/1929 | Rood | 454/335 |
| 2,293,065 | 8/1942 | Kiczales | 454/335 |
| 3,196,895 | 7/1965 | Dayus | 454/335 X |
| 3,495,521 | 2/1970 | Foster | 137/601 X |
| 4,506,825 | 3/1985 | Grant | 137/601 X |
| 4,513,655 | 4/1985 | Dayus | 454/336 X |
| 5,411,438 | 5/1995 | White et al. | 137/601 X |
| 5,769,709 | 6/1998 | Kim | 454/335 X |

*Primary Examiner*—Harold Joyce
*Attorney, Agent, or Firm*—Mark T. Basseches, Esq.

[57] ABSTRACT

An actuator assembly for a multi-blade damper includes a base plate having slots extending longitudinally thereof and slidably receiving drive portions of the louver shafts. A series of drive slots extending generally perpendicular to the clearance slots is formed at each side of the clearance slots. A series of link assemblies are keyed to the shafts, the link assemblies including actuator pins extending into selected ones of the drive slots. A clamp connection interposed between the link and drive portion of the louvers permits relative adjustment of the link relative to the louver. Movement of the base plate parallel to the plane defined by the axes of the louvers results in tilting of the louvers in a selected direction, dependent upon which of the series of drive slots is occupied by a pin of a respective link.

11 Claims, 6 Drawing Sheets

DAMPER ACTUATOR ASSEMBLY

BACKGROUND AND FIELD OF THE INVENTION

The present invention is directed to a damper actuator assembly, and more particularly, to a actuator assembly for multi-blade dampers. Still more particularly, the invention relates to a universal actuator assembly which is compatible with and adapted to operate multi-vane dampers, including parallel blade dampers, opposed action dampers, and combinations thereof.

PRIOR ART

Virtually all air conduit installations, ventilating systems and the like include damper units adapted to regulate air flow. Multi-vane or blade damper assemblies comprise a frame adapted to be mounted in an air conduit or venting passage. Pivotally mounted within the frame are a series of blades, or vanes, mounted on shafts, the shafts, in turn, being pivotally supported at their opposite ends on parallel rails forming a part of the frame. The pivots or shafts mounting the blades are disposed in coplanar alignment. Typically, the blades are mounted such that they may be disposed in coplanar alignment, essentially closing the frame to prevent air flow through the frame.

In certain assemblies, the blades may be pivoted so as to remain parallel to each other, the resistance of flow through the frame being at a minimum when the vanes are in planes perpendicular to the plane of the frame, resistance progressively increasing as the blades are shifted from parallel planes to coplanar alignment. A great number of variations of blade movement are frequently encountered, i.e., blades may pivot in opposite directions when moving from closed to open positions. Other damper assemblies may include combinations of blades which pivot in the same direction, and other blades which pivot in an opposite direction. In certain more complex damper assemblies, blades of different sizes may be incorporated in a single installation.

Typically, damper assemblies include a drive mechanism, i.e., a geared drive motor, which transmits rotary motion to a blade of the assembly, the assembly including a linkage mechanism which drives the other blades of the system in a coordinated manner to the desired end that blades will shift smoothly from a fully closed, or fluid blocking, position, to a fully open, or fluid passing, condition. In alternate known assemblies, a linear drive mechanism is coupled to the multiple blades by linkages extending from the drive mechanism.

The mounting and coupling of linkages to multi-blade damper devices has heretofore been a difficult task, requiring the services of highly skilled mechanics. If the links are not of precisely accurate length, and if the angular orientation between link and blade shaft is not precisely calculated, various operating flaws will inevitably result. By way of example, the blades may bind in a partly opened condition, the blades may not form an efficient blocking seal in the fully closed condition, the blades may not provide minimal resistance to air flow in the fully opened condition, etc.

As will be apparent from the foregoing, there is a long-felt need for a damper assembly of the multi-vane type which can be readily constructed by relatively unskilled labor, which is free from binding, and which will accommodate parallel pivoting and reverse pivoting blades, as well as blades of different sizes. Further, there is a long-felt need for a blade actuator assembly for multi-blade dampers which will require a minimum of stock parts.

SUMMARY OF THE INVENTION

The present invention may be summarized as directed to an operating assembly for multi-blade dampers which is universal in its application, which can be readily fabricated from a limited number of parts by relatively unskilled labor, and which is capable of driving a variety of combinations of blade sizes and pivot directions. The invention is further directed a damper operating assembly which includes a stock material which may be supplied in extended lengths, either as a coil or as extended lengths from which increments may be severed in accordance with the requirements of a particular installation. Still more particularly, the invention is directed to a universal drive assembly adapted to be coupled to conventional multi-blade damper devices, such as, by way of example, as shown in FIGS. 2*a* and 2*b* of the instant application.

More specifically, the present invention is comprised of an operator assembly including a rigid planar base adapted to be mounted parallel to the side of the frame on which the blades, or vanes, are pivotally mounted. The plate includes a plurality of longitudinally extending clearance slots defining a channel through or into which drive portions of the blades project, whereby the plate may be shifted upwardly and downwardly parallel to the frame side without interference from the blade drive portions. The plate includes a first and a second series of drive slots located to opposite sides of the clearance slots, the drive slots running essentially perpendicularly relative to the longitudinal axis of the drive plate (the term "essentially perpendicularly" as used herein being intended to encompass a slight angular offset from strict perpendicularity of from about 10°–20°).

Each shaft portion of a respective blade or vane has non-rotationally mounted thereto a drive link, the opposite end of the drive link (spaced from the blade axis) includes an actuator pin mounted within a selected one of the drive slots. The drive links may be non-rotatably coupled to the louver shafts in a number of adjustable positions. Upon movement of the drive plate parallel to the frame side, the drive pins will be carried with the plate and are free to slide within the drive slots, whereby the vanes are pivoted as a result of linear movement of the drive or base plate. Blades which are coupled to drive slots of a first series will pivot in a first direction, whereas blades coupled to drive slots of the second series will be pivoted in the opposite direction.

As will be apparent from the foregoing, the installer need merely mount the base plate adjacent the side of the frame through which the blade axes project, and by appropriately mounting the drive links to the blade shafts and drive slots, provide an assembly which perfectly operates damper assemblies of even the most complex construction.

In accordance with the foregoing, it is an object of the invention to provide a drive assembly for multi-blade dampers which can be readily installed, which is universal in its application, and which will control even the most complicated blade combinations and blade sizes. Still a further object of the invention is provision of an assembly of the type described characterized in that the drive assembly is comprised of a minimum number of parts, which parts may nonetheless be adapted to control units of a wide variety of size and complexity. Still a further object of the invention is the provision of a universal control assembly for multi-vane damper devices, which obviates the necessity that the same be constructed by highly skilled personnel.

DETAILED DESCRIPTION OF DRAWINGS

Figure 2A:
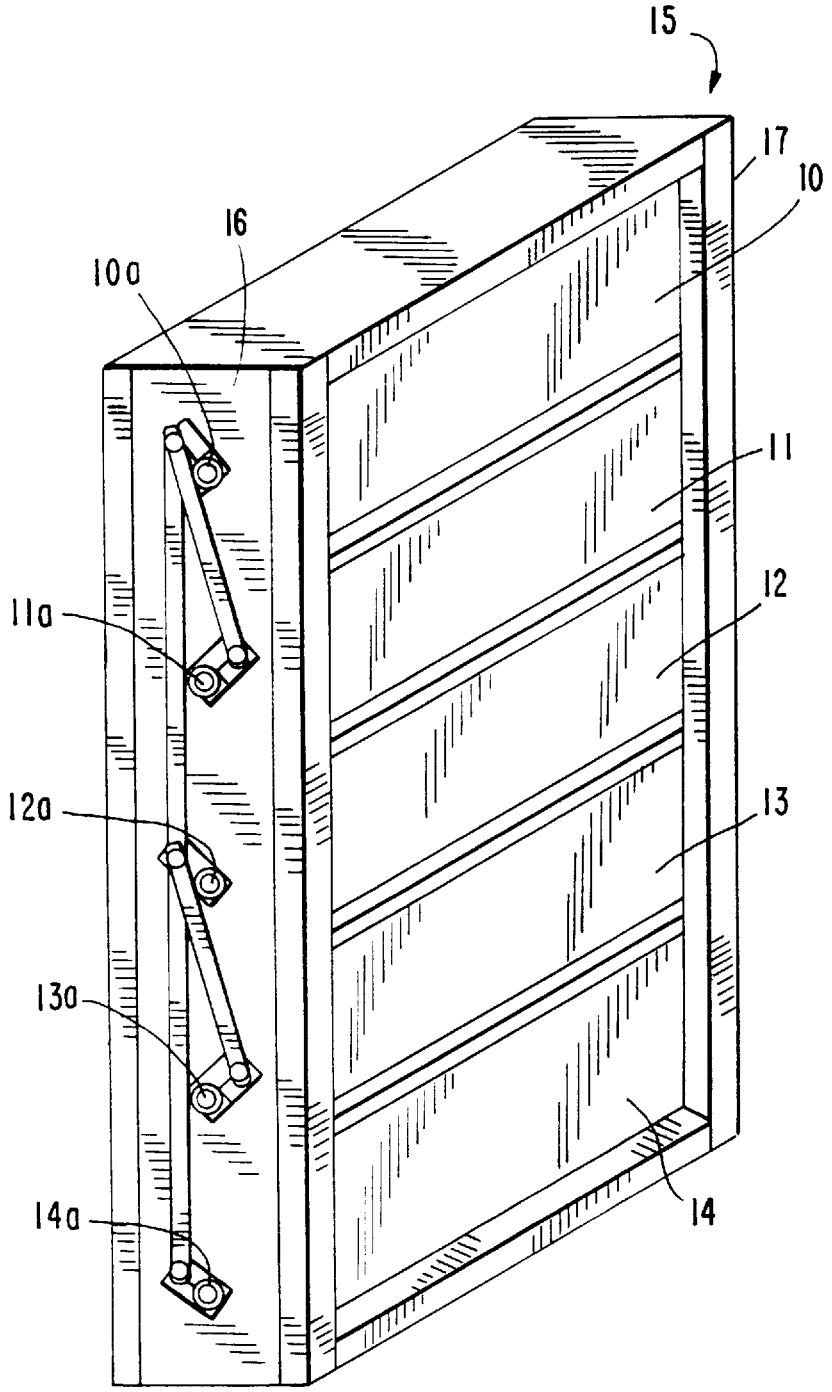
FIG. 2a PRIOR ART
FIGS. 2A and 2B are illustrations of a prior art damper assembly, respectively in the damper closed and the damper opened conditions.
Figure 2B:
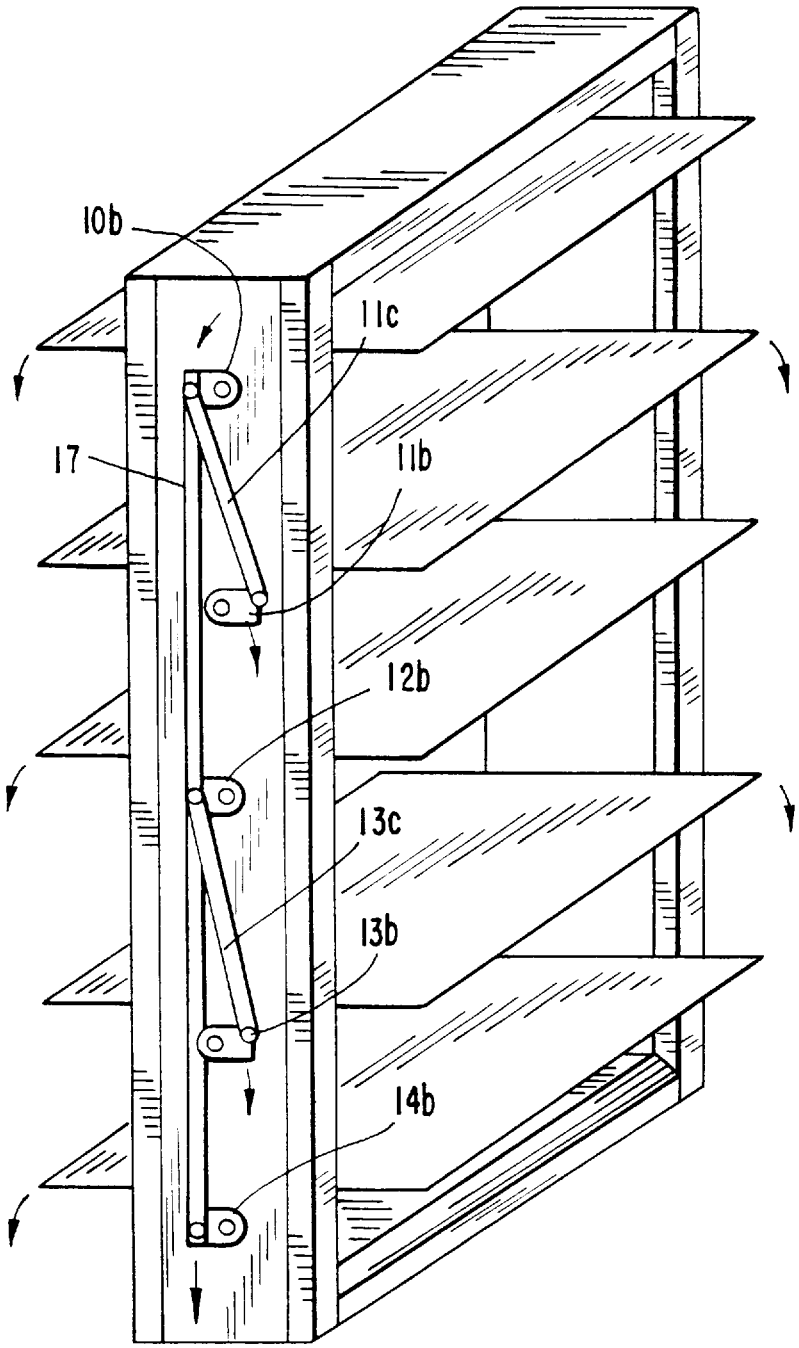
FIG. 2b PRIOR ART

As conducive to an understanding of the invention, reference will first be made to a conventional, multi-vane damper assembly and linkage therefor, as appearing in FIGS. 2A and 2B. The prior art assembly is depicted as including five separate louvers, 10, 11, 12, 13, and 14. In the schematic view of FIGS. 2 and 2A, louvers 10, 12, and 14 are depicted as pivoting in an anti-clockwise direction from closed (FIG. 2A) to open (FIG. 2B). Louvers 11 and 13 pivot in a clockwise direction, as viewed in these figures.

The louvers 10–14 are pivotally mounted in a frame 15 between side rails 16 and 17. The louvers 10–14 include drive portions 10A–14A, respectively, extending laterally beyond side rails 16. A series of drive links 10B–14B are clampingly connected to the drive portions 10A–14A, respectively. The links 10B–14B are driven by an operating assembly, including a drive rod 17 coupled to the anti-clockwise operating links 10B, 12B, and 14B, by pivots. The rod 17 is connected to the clockwise opening links 11B and 13B by drive levers 11C and 13C, respectively.

As is obvious from the illustrations, when the rod is shifted downwardly, the louvers 10–14 are caused to rotate in the desired directions, it being understood that motive force may be applied either directly to the rod 17 or to one of the louvers as by a geared motor.

As will be immediately evident, the calculation of the length of the respective parts, and particularly of the drive levers, is dictated by the size of the damper blades. If one or more of the drive levers is improperly dimensioned, the entire assembly may bind or may be incapable of shifting to a fully opened or fully closed condition. The construction problem is exacerbated where the louver assembly employs vanes or blades of a variety of widths. Thus, it will be appreciated that the construction of a damper assembly which will efficiently shift the blades from a fully opened to a fully closed position in synchronism requires the services of an expert machinist who must calculate the appropriate dimensions, often on a trial-and-error basis. Parts for the assembly, and particularly the operating levers, must be fabricated to order, often on the job site.

Figure 1:
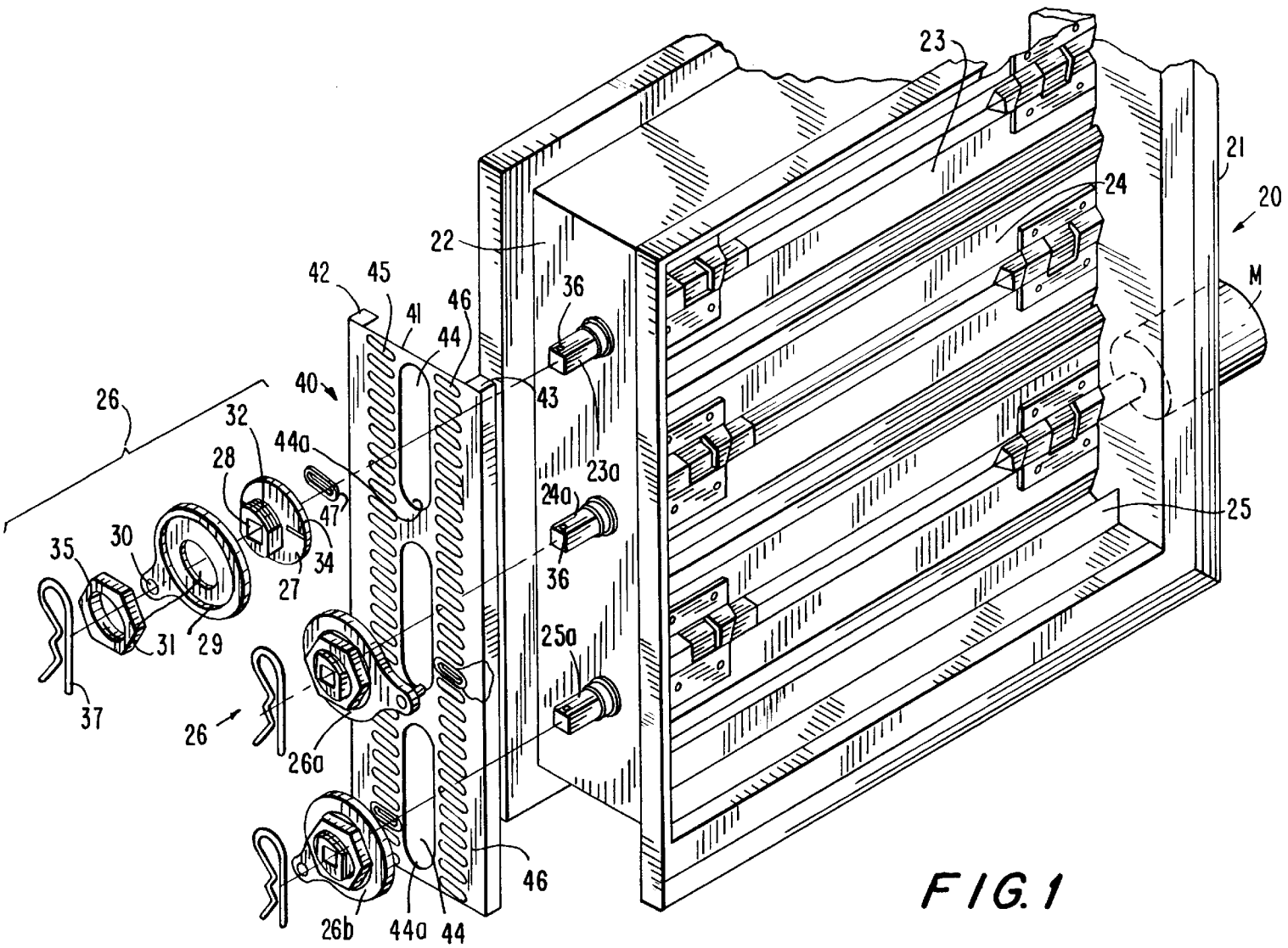
FIG. 1 is an exploded perspective view of a damper assembly including an operator assembly in accordance with the invention.

There is depicted in FIG. 1 a unique operating assembly for a damper which eliminates the drawbacks of conventional damper operators and which permits unskilled labor to fabricate operating systems for even the most complex louver arrangements, utilizing a limited number of stock parts.

Referring now to FIG. 1, there is schematically depicted a damper assembly comprising a frame 20 including parallel side rails 21, 22, between which are mounted three operating vanes or blades 23, 24, 25. In the illustrated embodiment, the blades are pivotally mounted for rotation about drive axes coincident with the center of the blade. However, the operating system of the invention is equally effective for edge-pivoted blades. The blades, which are depicted in FIG. 1 in the closed, or damper blocking, position thereof, include drive portions 23A, 24A, 25A, projecting beyond side wall 22. The drive portions in the illustrated embodiment are square so as to afford non-rotatable connection with the drive link assemblies 26. The link assemblies include a base casting 27 having a through-going aperture 28 sized to non-rotatably encompass the square drive portions 23A, etc. The drive link assemblies include a drive link member 29 having a drive pin 30 laterally offset from the central axis of a clearance aperture 31 in the link. The clearance aperture is sized to receive threaded shank portion 32 extending axially from casting 27.

Figure 3:
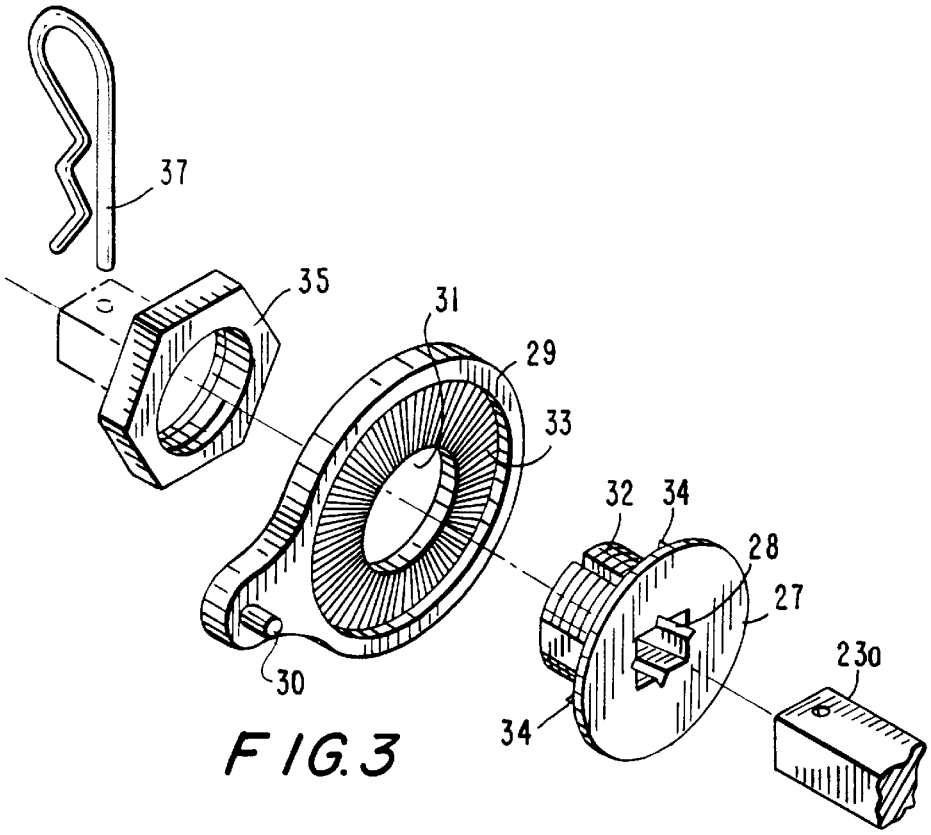
FIG. 3 is a magnified, exploded perspective view of a drive link assembly in accordance with the invention.
Figure 4:
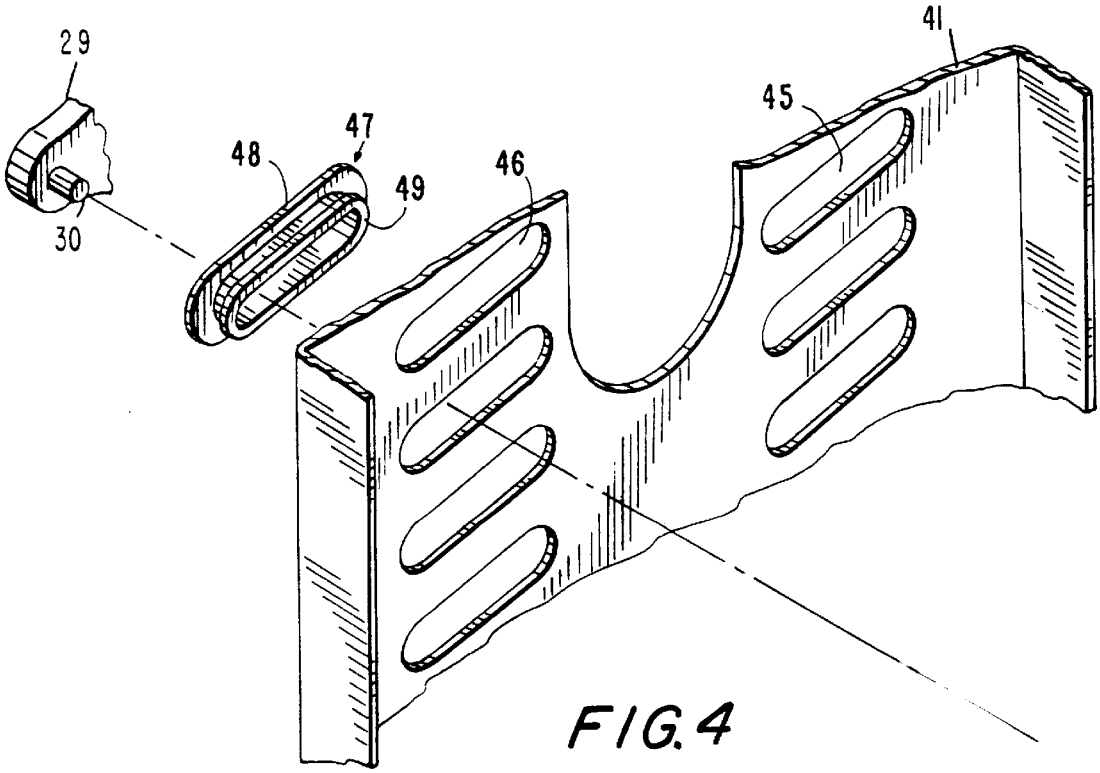
FIG. 4 is a magnified, fragmentary perspective view of the connection assembly between the drive plate and a drive link.
Figure 5:
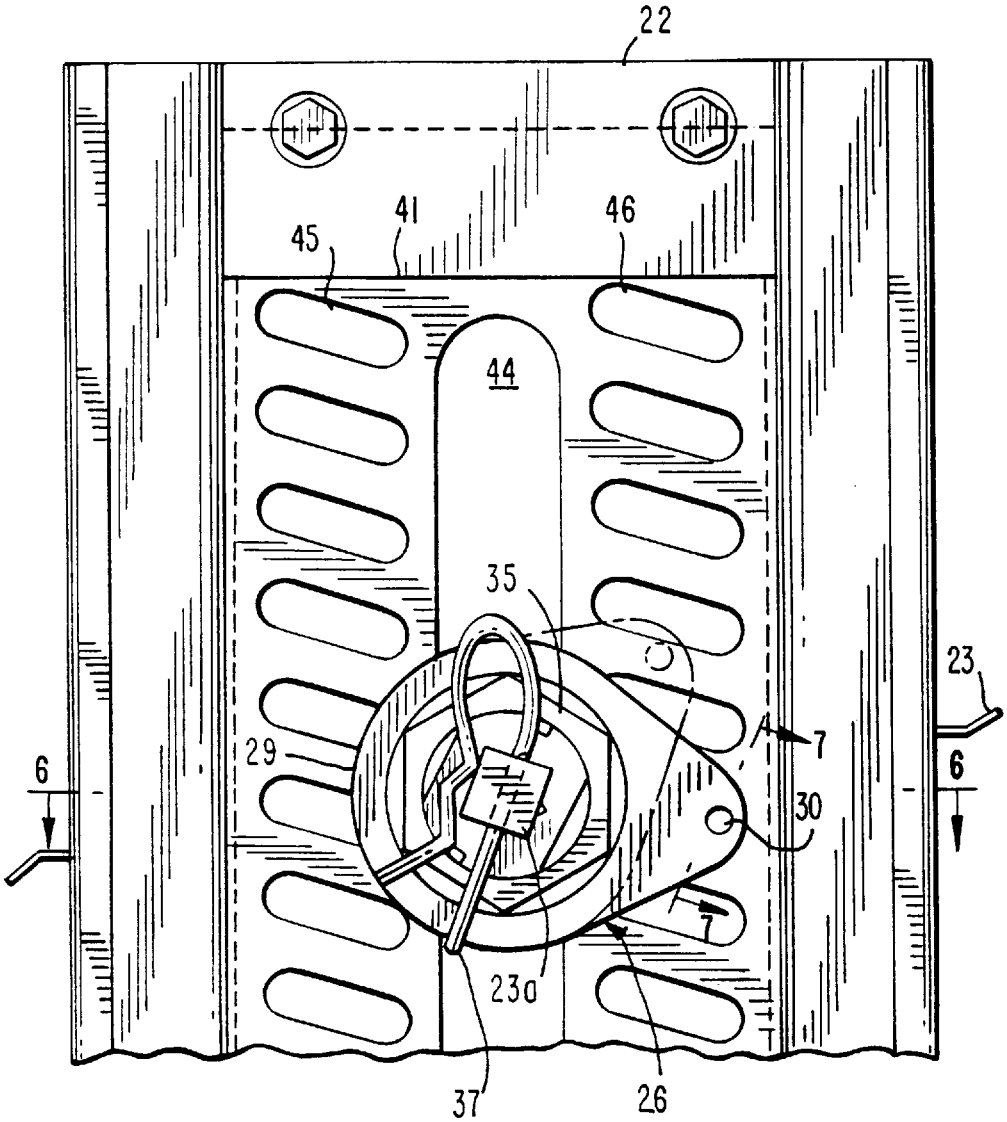
FIG. 5 is a fragmentary side elevational view of the drive plate and a drive link in two conditions of operation of the damper drive assembly.
Figure 7:
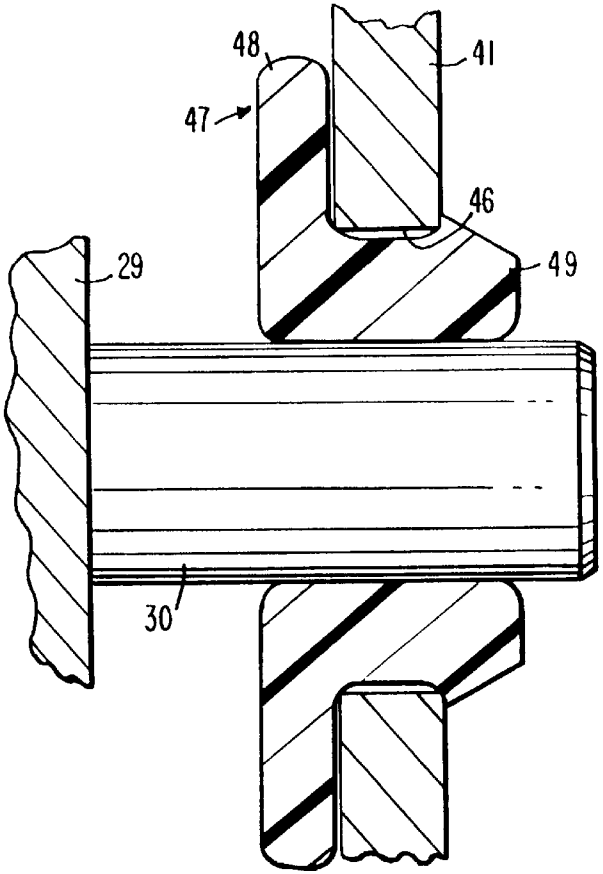
FIG. 7 is a magnified sectional view taken on the line 7—7 of FIG. 5.
Figure 6:
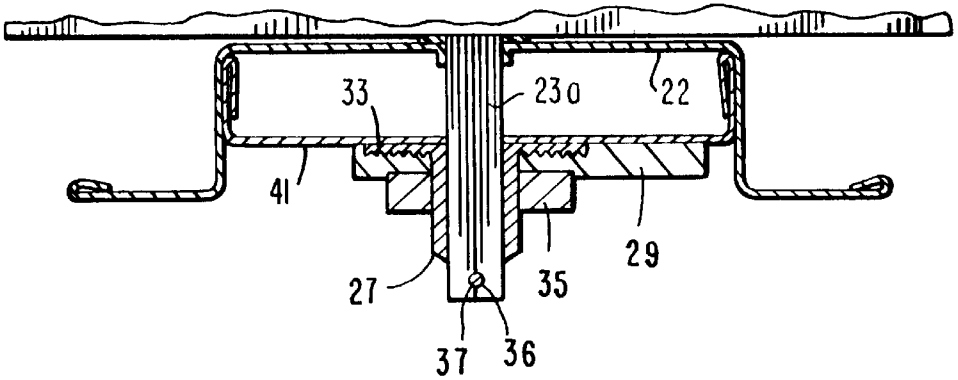
FIG. 6 is a section taken on the line 6—6 of FIG. 5.

As best seen in FIG. 3, the inner face 33 of link 29 is formed with a multiplicity of radially directed serrations or slots 33 sized to complementally receive drive teeth 34 formed on the outer face of casting 27.

The link assembly 26 includes a clamp nut 35 adapted to be threaded over shank 32 of the casting.

As will be evident from the foregoing, the nut 35, when threaded over shank 32, will clamp drive link to casting 37 in any of a multiplicity of angularly oriented positions.

The drive portions 23A, 24A, 25A include lock apertures 36 for reception of locking pins 37.

Motive force for driving the three illustrated drive link assemblies 26, 26A, 26B, is provided by a drive plate assembly 40. The drive assembly 40 may be supplied as an elongated roll of flatwise stock material which is bent by the contractor to a "U" configuration including side legs 42, 43. Alternately, the drive plate assembly may be cut from a length of preformed stock to the "U" configuration or may be comprised of a flat stock of substantial rigidity. Drive plate assembly includes a plurality of centrally located longitudinally extending, mutually spaced clearance slots 44. The spacing of slots 44 is such as to enable the plate to slidably encompass the projecting drive portions 23A, 24A, 25A. It is feasible, in installations using vanes of large size, simply to cut the material away between adjacent clearance slots 44, where the spacing of the drive portions of the specific installation dictate.

At opposite sides of the central clearance slots 44, the plate 41 is formed with a first series and a second series of drive slots 45, 46, respectively. The slots 45 and 46 are directed generally perpendicularly to the longitudinal axis of base plate 41, the term "generally perpendicular" as used herein encompassing inclinations from 0° to about 20° from strict perpendicularity. Optionally, but preferably, the slots are inclined at angles from about 10° to 20° (15° being optimal) from strict perpendicularity, angles within this range having been found to operate the louvers most smoothly and with minimal likelihood of binding.

In order to assure a smooth binding-free operation, there is preferably provided a series of slide bushings 47 including a stop collar 48 and a shank portion 49. The shank 49 is insertable through a selected one of the lateral slots of series 45 and 46. The bushings 47 are made of wear-resistant material, i.e., nylon.

Initial Installation

The drive assembly is connected to the louvers as follows. Base plate 41 is mounted adjacent side rail 22 with the drive portions 23A, 24A, 25A extending through respective clearance apertures 44. With the louver assembly in the closed condition, as depicted in FIG. 1, the plate is shifted upwardly to the maximum extent possible such that drive portions 23A, 24A, 25A lie adjacent the bases 44A of clearance slots 44. With the parts thus positioned, castings 27 are sleeved over drive portions 23A, 24A, 25A. Next, a drive link 29 is sleeved over shank 32 of each said casting, and rotated relative to the stationery casting in such manner that the drive pin 30 of the respective drive link 29 enters into the lowest one of the slots 45 or 46, as appropriate, which can possibly register with the pin. Obviously, the pin will enter the selected one of the slots of series 45 or 46 at that portion of the slot which is nearest the center line of the drive plate 44.

As will be evident from an inspection of FIG. 1, where the drive pin enters slot 45, the respective blade to which that drive assembly 26 is linked will open in an anti-clockwise direction. Conversely, when a drive pin enters into a slot of series 46, when the drive plate is driven downwardly, that respective vane or blade will be driven in a clockwise direction. When the appropriate drive slot in the series 45 or 46 is established, an anti-friction bushing 47 is mounted in the selected slot so as to provide an efficient sliding connection between the drive pin 30 and the base plate 41.

Following location of the drive pins and bushings, clamp nut 35 is applied over threaded shank 32 of casting 27 so as to non-rotatably lock drive link 29 to the casting, which casting is, in turn, non-rotatably keyed to a respective drive portion, e.g., 23A, of a vane. After application of the clamp nuts 35, pins 37 are inserted into the apertures 36 of the drive portions.

Operation of the device will be evident from the preceding description. When the damper assembly is actuated, e.g., by geared drive motor M (FIG. 1), drive portion 25A will rotate drive assembly 26B in a downward, or anti-clockwise, direction. In turn, by the interfit of pin 30 in an appropriate slot of the series 45, the drive plate will be driven downwardly, thereby drive assembly 26A keyed to drive portion 24A will cause blade 24 to shift in a clockwise direction. Similarly, blade 23, as a result of the downward movement of the plate 41, will be shifted in an anti-clockwise direction, whereby the louvers or vanes will be shifted from the closed condition illustrated to an open or a partly open condition, in accordance with the desired amount of rotation imparted by motor M. Counter-rotation of the motor will restore the vanes to the illustrated closed position.

As will be apparent from the preceding description, there is provided, in accordance with the invention, a drive assembly useful with conventional damper constructions. The drive assembly may be connected to a wide variety of damper installations rapidly and through the use of relatively unskilled labor. The linkage requires a minimum of maintenance and may be readily adapted to damper assemblies using extremely large blades by simply cutting away the material between two clearance slots to accommodate the greater spacing between vane axes. The drive assembly requires only a minimum of stock parts, notably, a length of base plate forming stock material and link assemblies. No calculation or forming of links to size is required.

As will be apparent to those skilled in the art who have been familiarized with the instant disclosure, numerous variations in details of construction may be made without departing from the spirit of the invention. Accordingly, it is intended that the claims be broadly construed to encompass functional equivalents.

We claim:

1. In a damper assembly including a frame, a plurality of damper blades mounted in said frame, said blades including a drive shaft pivotally mounted on and having a drive portion projecting beyond a side portion of said frame, said drive shafts being disposed in coplanar alignment, the improvement comprising a universal operator assembly, including a rigid elongate planar base portion adapted to be mounted adjacent and movable relative to said frame in a drive direction parallel to the plane of said axes, a plurality of longitudinally spaced elongate clearance slots centrally located in said base and aligned with said plane of said shafts, each said drive portion extending through a respective said clearance slot, a first and a second series of regularly spaced elongate drive slots formed in said base portion, said drive slots being directed generally perpendicular to the longitudinal axis of said base portion, said first and second series being disposed as opposite sides of said clearance slots, and a drive link means non-rotatably coupled to each said drive portion, said link means including an actuator pin slidably disposed within a respective drive slot, whereby said shafts are rotated responsive to movement of said operator assembly in said drive direction.

2. An assembly in accordance with claim 1, and including anti-friction bushing means interposed between said actuator pins and said drive slots.

3. An assembly in accordance with claim 1, and including a parallel pair of leg members extending from the side margins of said base portion.

4. An assembly in accordance with claim 1, wherein said first and second series of drive slots are inclined at angles offset from perpendicular to said longitudinal axis by from about 10° to 20°.

5. An assembly in accordance with claim 1, wherein said drive link means comprise a coupling portion keyed to said drive portion, a link portion having said actuator pin mounted thereon, and clamp means interposed between said link and coupling portions for non-rotatably connecting said link member to said coupling member in any of a multiplicity of angularly oriented positions.

6. A universal damper operator kit adapted to be mounted in driving connection to a damper assembly of the type comprising a frame, a series of parallel, mutually spaced drive shafts rotatably mounted on said frame, said shafts including a drive portion projecting laterally beyond a side of said frame, each said shaft having a damper blade mounted thereon, said kit comprising a plurality of drive link means having key means adapted to be non-rotatably mounted to a said drive portion, said link means including an actuator pin spaced from said key means and extending perpendicular to said link, a drive plate including a rigid base portion adapted to be mounted adjacent said side of said frame for movement parallel to said side, said drive plate including a plurality of elongate clearance slots aligned with the longitudinal axis of said base portion, said slots adapted to slidably receive said drive portions, a first and a second series of regularly spaced elongate drive slots formed in said base portion, said drive slots being directed generally perpendicular to the longitudinal axis of said base portion, said first and second series being disposed at opposite sides of said clearance slots, said drive slots being adapted to slidably receive said actuator pins.

7. A kit in accordance with claim 6, and including anti-friction bushing means adapted to be interposed between said actuator pins and said drive slots, said bushing means including an elongate slot portion adapted to be aligned with a respective said drive slot.

8. A kit in accordance with claim 6, wherein said drive plate includes parallel leg members extending from the longitudinal side edges of said base plate.

9. A kit in accordance with claim 6, wherein said drive slots are inclined at angles offset from perpendicular.

10. A kit in accordance with claim 6, wherein the angle of offset of said drive slots from perpendicular is from about 10° to 20°.

11. A kit in accordance with claim 6, wherein said drive link means comprise a coupling portion adapted to be keyed to said drive portion and a link portion, said actuator pin being mounted on said link portion, and clamp means interposed between said link and coupling portions for non-rotatably connecting said link portion to said coupling portion in any of a plurality of angularly oriented positions.

* * * * *